United States Patent [19]

Slomkowski

[11] 3,972,139

[45] Aug. 3, 1976

[54] DEVICE FOR DISPLAYING NUMBERS

[75] Inventor: John J. Slomkowski, Bethpage, N.Y.

[73] Assignee: Large Scale Readouts, Inc., Farmingdale, N.Y.

[22] Filed: Oct. 21, 1974

[21] Appl. No.: 516,184

[52] U.S. Cl. ..... 40/28 C; 40/130 E; 340/336

[51] Int. Cl.[2] ..... G09F 9/34

[58] Field of Search ..... 40/130 E, 130 K, 132 D, 40/28 C; 340/336, 334, 324, 339, 378; 240/46.39; 217/32, 33

[56] References Cited

UNITED STATES PATENTS

| | | | |
|---|---|---|---|
| 3,137,082 | 6/1964 | Phlieger | 40/28 C X |
| 3,226,864 | 1/1966 | Rehler | 40/130 K |
| 3,249,932 | 5/1966 | Sklaroff | 340/336 X |
| 3,608,222 | 9/1971 | Koch | 40/130 E |
| 3,728,808 | 4/1973 | Rieth | 40/130 E |

*Primary Examiner*—John F. Pitrelli

*Attorney, Agent, or Firm*—Bauer, Amer & King

[57] ABSTRACT

A number-displaying device wherein a light chamber of an external unit is sub-divided by units wedged therein into seven compartments in a figure eight array, such that by selectively energizing an appropriate combination of seven lights (one in each said compartment), any number from zero to nine is formed in the display area of the device.

2 Claims, 10 Drawing Figures

DEVICE FOR DISPLAYING NUMBERS

The present invention relates generally to devices, using lights, for displaying numbers, and more particularly to an improved display device of this general classification wherein only seven lights are required in conjunction with very simple component parts that are assembled with ease and great facility.

As generally understood, light displays for numbers or the like, usually require 37 bulbs in a figure eight array or setup in order to effectively form any number from zero to nine. Among other disadvantages such as initial high cost and excessive space requirements, these known displays require frequent maintenance, since failure of one or more bulbs adversely effects the display, and the likelihood of such failure is a major consideration in view of the number of lights or bulbs used for each number display.

Broadly, it is an object of the present invention to provide a number-displaying device characterized by an optimum, minimum number of lights, and consequently overcoming the foregoing and other shortcomings of the prior art. Specifically, it is an object to diffuse the light from a single source throughout a cooperating light compartment, such that seven compartments, appropriately arranged, are effective to form any number from zero to nine, and only one light source per compartment is required, making a total of only seven for each number display.

An exemplary display device using lights to form a number display which demonstrates objects and advantages of the present invention includes a rectangular body having an identically sized top and bottom and comparatively larger sized left and right sides, said top, bottom and left and right sides being arranged in cooperating facing relation to bound a light chamber. Seven chamber-dividers, each comprised of a springy metal, are wedged against each other within the light chamber, and are effective in sub-dividing the same into seven compartments in a figure eight array or setup. Completing the device are seven lights, each located in one of the seven compartments, such that the energization of select combinations of these lights forms a number display in the rectangular opening of each light chamber.

The above brief description, as well as further objects, features and advantages of the present invention, will be more fully appreciated by reference to the following detailed description of presently preferred, but nonetheless illustrative embodiments in accordance with the present invention, when taken in conjunction with the accompanying drawings, wherein:

FIG. 1 is a perspective view thereof;

FIG. 2 is a front view illustrating further structural details;

FIG. 3 is a fragmentary side elevational view, in section, taken on line 3—3 of FIG. 2, showing further structural details; and FIG. 4 is an exploded perspective view thereof, most clearly illustrating the assembly thereof.

FIG. 6 is a front elevational view showing further structural details; and

FIG. 7 is an end elevational view, on an enlarged scale, of the light chamber divider used in this embodiment; and FIGS. 8–10 illustrate a fourth embodiment, wherein FIG. 8 is an exploded perspective view thereof;

FIG. 9 is a detailed view illustrating the manner in which components of this embodiment are assembled; and FIG. 10 is a front elevational view, illustrating the device in its assembled condition.

Figure 1:
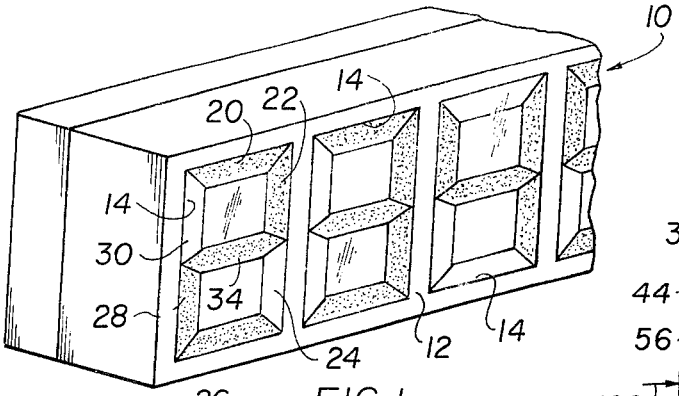
FIGS. 1–4 illustrate a first embodiment of a number-displaying device according to the present invention. Specifically.

The several embodiments of a number-displaying device according to the present invention are of the type, as illustrated more particularly in FIG. 1, which are capable of displaying, using lights, any number from zero to nine. Thus, as illustrated in FIG. 1, the device, generally designated 10, includes a front or display area 12, upon which there is displayed the number "2", "3", and "4". The aforesaid numbers are each displayed in identical light chamber openings, individually and collectively designated 14 which, as illustrated in FIG. 1, are arranged side-by-side in the display area 12. Each opening 14 is in turn sub-divided into seven compartments. Starting with the top compartment and proceeding clockwise, these seven consist of a top compartment 20, upper and lower right side compartments 22 and 24, a bottom compartment 26, lower and upper left side compartments 28 and 30, and finally a horizontally oriented middle compartment 34. For simplicity sake, the compartment-identifying reference numerals have only been applied to those compartments displaying the number "2", it being understood that similar compartments are utilized to display numbers "3" and "4", and for that matter any other number from zero to nine. As should be readily appreciated, by appropriate selection of the compartments, any number from zero to nine can be readily formed.

Figure 4:
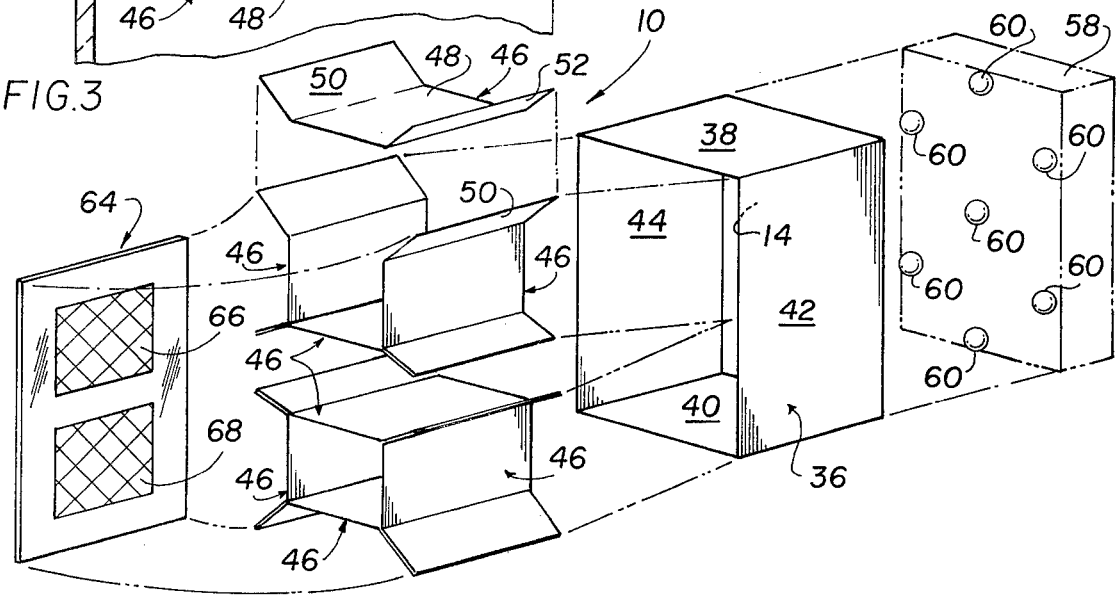

While there are number-displaying devices utilizing seven compartments arranged in the manner just described, there are no known display devices in which said compartments are formed in the noteworthy facilitated manner characterizing the present invention. Specifically, as is perhaps best understood from FIG. 4, device 10 includes for each number display a rectangular body 36 which consists of identically sized top and bottom panels 38 and 40, and comparatively larger right and left side panels 42 and 44. The aforesaid cooperate to bound each of the previously noted light chambers 14.

To sub-divide each light chamber 14 into the discrete seven light compartments 20, 22, 24, 26, 28, 30 and 34, use is made of seven identically constructed chamber-dividers, individually and collectively designated 46. Since all of the dividers are identically constructed, the description of one, which now follows, will suffice for a complete understanding of the present invention. Specifically, each divider 46 is preferably formed of a springy metal material of construction and includes a medial panel 48 and two angularly oriented panels 50 and 52. The seven dividers 46 are of a size in relation to the volume of the light chamber 14 that results in the dividers 46 being wedged against each other so that there is contact therebetween with some degree of friction preventing inadvertent dislodging of any sub-divider from its position within the light chamber 14. The aforesaid can be better understood from FIG. 2, to which reference is now made.

Figure 2:
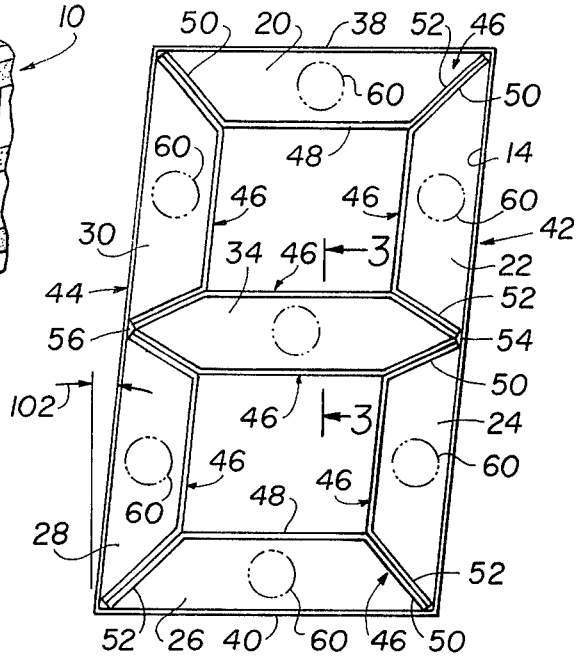

As illustrated in FIG. 2, the uppermost divider 46 is provided with an internal position within the light chamber 14 relative to the top 38 so that the medial panel 48 cooperates therewith to provide the light compartment 20. In this regard, the angularly oriented panels 50 and 52 are effective in maintaining the medial panel 48 in a clearance position from the top 38.

In very similar fashion the medial panel 48 of the bottom divider 46 cooperates with the bottom 40 to form the light compartment 26.

Next, either the right or left light compartments are preferably formed. Using the right light compartments 22, 24 as an example, the same are formed using two dividers 46 oriented vertically so that panel 50 of the upper divider 46 seats against panel 52 of the compartment 20 divider, whereas the angularly oriented panel 52 of the bottom divider 46 similarly seats against panel 50 of the bottom light compartment 26 divider. The other angularly oriented panels 52 and 50 of the right side dividers 46 converge at reference point 54, which will be understood to be approximately at the mid-point of right side 42.

In similar fashion, the upper and lower left side dividers 46 are inserted in the light chamber 14 and cooperate with the upper and lower portions of left side 44 to form the two light compartments 28 and 30.

The remaining horizontally oriented medial compartment 34 is formed by two dividers 46 disposed in facing relation to each other, as illustrated, and inserted so that they span between the previously noted reference point 54 on one side, and a similarly located reference point 56 located approximately at the mid-point of left side panel 44.

Figure 3:
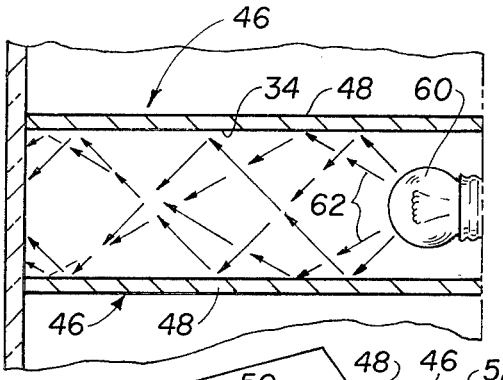

Reference should now again be made to FIG. 4 wherein it is shown that rearwardly of the light chamber 14 on an appropriate support structure 58, such as a rectangular block or the like, are seven electrically-energized lights or light sources, individually and collectively designated 60. As may best be appreciated by consideration of FIG. 3 in conjunction with FIG. 4, each light 60, which will be understood to be a conventional light bulb, is located rearwardly and approximately in the middle of each cooperating light compartment, which light compartment as illustrated in FIG. 3 is the medial, horizontally oriented light compartment 34. When bulb 60 is electrically energized, light rays 62 are produced which reflect along the compartment 34 between the medial panel 48 of the two facing dividers 46 which, as already noted, cooperate to to form the light compartment 34. As a result of the interreflection of the light rays 62 between the dividers 46, light from bulb 60 is effectively diffused so that one viewing the display of device 10 is not conscious of a bright spot or light concentration at the location of the bulb 60. Additionally, the interreflection carries the light rays 62 to the end of the compartment 34, thereby illuminating this compartment for number-display purposes. That is, using the number "2" display of FIG. 1 as an example, energization of bulb 60 in light compartment 34 provides the horizontally oriented middle leg of the number "2".

In a preferred embodiment, completing the number-display 10 of FIGS. 1–4, is a plastic cover 64 which fits over the opening of each light chamber 14. It is optional, but not required in this embodiment, for the cover 64 to have two opaque areas 66 and 68, in the locations indicated, which locations are in alignment with unused, or display areas not needed, to form a number display from zero to nine.

Figure 5:
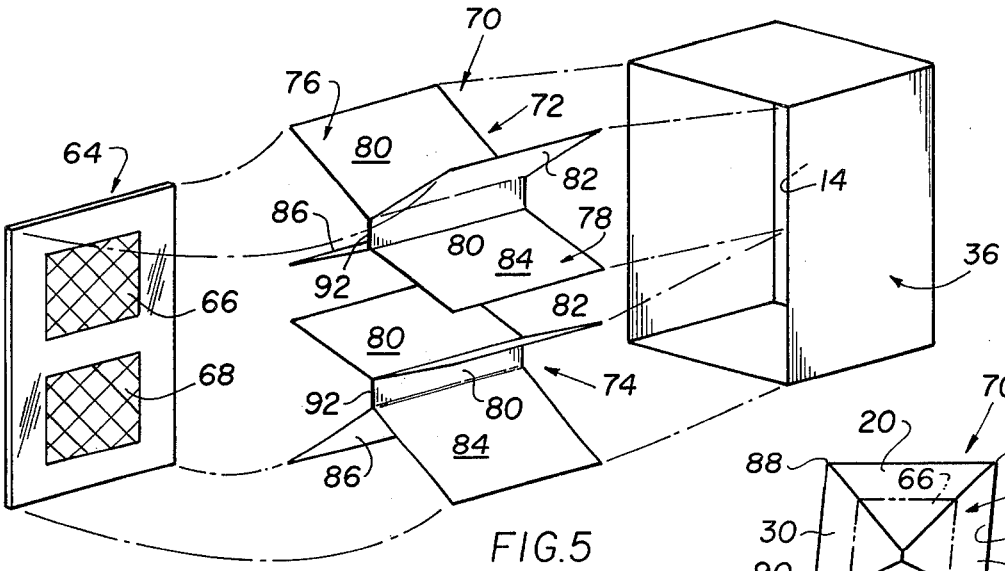
FIGS. 5–7 illustrate a second embodiment of a number-displaying device according to the present invention, wherein FIG. 5, like FIG. 4, is an exploded perspective view thereof.

Reference is now made to FIG. 5 illustrating a second embodiment of a number-displaying device according to the present invention, said device being generally designated 70.

Figure 6:
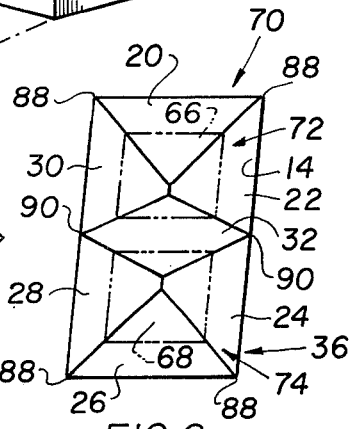

For simplicity sake, only the structural features of the embodiment of FIG. 5 which differ from those of the embodiment of FIGS. 1–4 will be described. In this regard, embodiment 70 has the same rectangular body 36 bounding a correspondingly shaped rectangular light chamber 14. It also has a plastic light-transmitting cover 64, but in this instance said cover is required to have opaque areas 66 and 68 in the locations indicated, for the reason which will soon be apparent. Embodiment 70 primarily differs from the embodiment 10 in the make-up and construction of the dividers 72 and 74 that are used to sub-divide the light chamber 14 into the seven compartments 20, 22, 24, 26, 28, 30 and 32, all as illustrated in FIG. 6. Each said divider 72 and 74 is actually a two-part unit comprised of members 76 and 78 joined together, as by welding or any other appropriate means, at the interface of their rectangular medial panels 80. Each of the members 72 and 74 is preferably formed of a springy metallic material of construction, and the joinder of the two units 76 and 78 to each other presents four angularly oriented panels 80, 82, 84 and 86. As best illustrated in FIG. 6, the contemplated assembly of the two units 72 and 74 within the light chamber 14 is one that results in the aforesaid angularly oriented panels being directed to each of the four corners 88 of the rectangular body 36, and also to the mid-points 90 of the opposite sides of said body.

After positioning of the units 72 and 74 in wedged relation within the light chamber 14, placement of the cover 64 over the opening into the light chamber 14 locates the opaque areas 66 and 68 in covering or masking relation over the forward edges 92 of the middle panels 80 and the areas adjacent thereto. As a consequence, as clearly illustrated in FIG. 6, opaque areas 66 and 68 leave only as exposed areas in the display 70 the areas coextensive with the seven light compartments 20–32.

Figure 9:
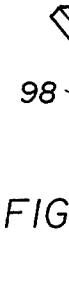
Figure 7:
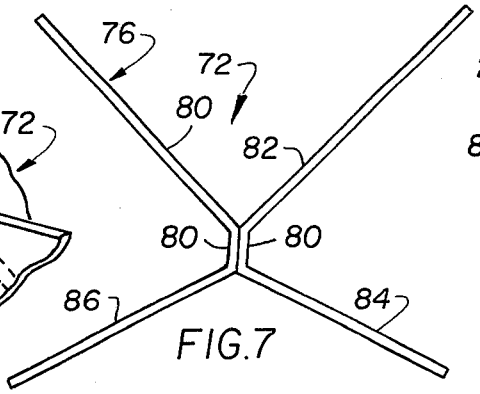
Figure 8:
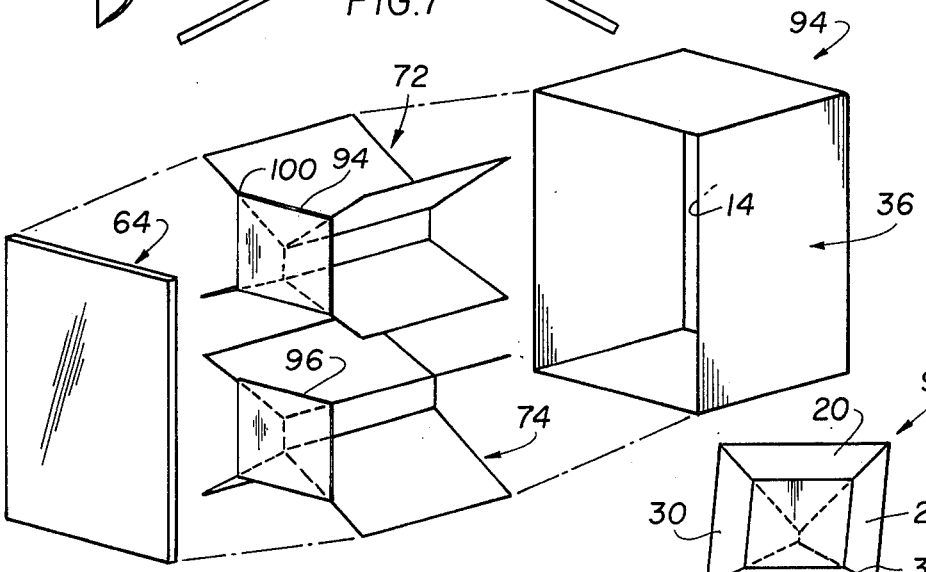
Figure 10:
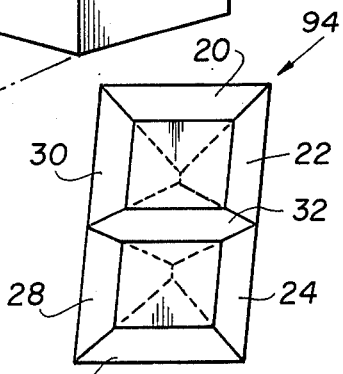

Reference is now made to FIGS. 9–10 illustrating a third embodiment of a number-displaying device according to the present invention. Device 94 illustrated therein has structural features similar to those already described which, for brevity sake, will not again be described. Specifically, embodiment 94 primarily differs from those already described in the manner in which the unneeded, and thus unused, portions of the number displays are blocked out. As best illustrated in FIG. 8, opaque plastic panels 94, 96 are appropriately mounted directly on the chamber dividers 72 and 74, rather than being incorporated as part of the light chamber cover 64. One way in which this mounting may be achieved is by notching the front ends 98 of the dividers 72, 74, as at 100, and snapping the panels 94, 96 in place in the located as illustrated. As in the other embodiments, assembly of device 94 then contemplates the placement of the two assemblies 72, 74 within the light chamber 14, in wedged together relation, to thereby form the light compartments 20, 22, 24, 26, 28, 30 and 32 as illustrated in FIG. 10. Placement of the cover 64 in the light chamber opening 14 completes the assembly of the unit.

From the foregoing it should be readily appreciated that there has been described herein number-displaying devices 10, 70 and 94 which are each characterized by simplicity in the component parts used and in the manner in which these component parts are assembled within a cooperating rectangular external housing. Said housing, incidentally, as best illustrated in FIG. 2, is traditionally oriented at a five degree or similar angle 102, but this is only optional. Among the significant advantages of the number-displaying devices according to the present invention, in addition to the ease of assembly and simplicity of component parts, is the ability to use only seven electrically energized light sources 60. This is in sharp contrast to numeric displays which traditionally require 37 bulbs in a figure eight array or setup.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A display device using lights to form any number from zero to nine comprising a rectangular body having an identically sized top and bottom comparatively larger sized left and right sides, said top, bottom and left and right sides being arranged in cooperating facing relation to bound a light chamber, plural identical and interchangeable chamber-dividers each comprised of a springy metal held in said rectangular body under stress and having operative wedged positions against each other within said light chamber so as to sub-divide said light chamber into an open and unobstructed light conducting compartment comprising a first compartment adjacent said top, a second compartment adjacent said bottom, third and fourth compartments adjacent said left side, fifth and sixth compartments adjacent said right side, and a seventh compartment oriented horizontally of the medial portion of said light chamber, each said metallic chamber-divider having a medial panel and opposite angularly oriented side panels, said chamber-dividers located adjacent said top, bottom and sides being positioned with said medial panel of each held in clearance positions therefrom by said side panels to thereby form said compartments, and said medial seventh compartment being formed by two said chamber-dividers disposed in facing relation to each other, and seven lights each located in each one of said open and unobstructed seven compartments, whereby the energization of select combinations of said lights forms a number display in said light chamber.

2. A display device as claimed in claim 1 including a cover having an operative position disposed over the opening of said light chamber and having rectangular opaque areas thereon in locations effective to confine the light rays from said lights to said compartments.

* * * * *